US012668328B1

(12) United States Patent
Roske et al.

(10) Patent No.: US 12,668,328 B1
(45) Date of Patent: Jun. 30, 2026

(54) HYDROFOIL APPARATUSES, SYSTEMS, AND METHODS FOR MARINE VESSELS

(71) Applicant: Brunswick Corporation, Mettawa, IL (US)

(72) Inventors: Daniel A. Roske, Fond du Lac, WI (US); Daniel J. Guse, West Bend, WI (US); Andrew C. Gunderson, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 422 days.

(21) Appl. No.: 18/215,304

(22) Filed: Jun. 28, 2023

(51) Int. Cl.
*B63B 1/24* (2020.01)
*B63H 1/24* (2006.01)
*B63H 5/10* (2006.01)

(52) U.S. Cl.
CPC ..... *B63B 1/246* (2013.01); *B63H 1/24* (2013.01); *B63H 5/10* (2013.01)

(58) Field of Classification Search
CPC ..... B63B 1/246; B63H 1/24; B63H 5/10
See application file for complete search history.

(56) References Cited

U.S. PATENT DOCUMENTS 863,681 A 8/1907 Warner
3,077,173 A * 2/1963 Lang ..... B63B 1/38 440/49
3,109,495 A 11/1963 Laug
3,162,166 A * 12/1964 Handler ..... B63B 1/283 114/280
3,994,253 A * 11/1976 Mathewson ..... B63B 1/286 114/277
5,046,444 A 9/1991 Vorus
5,551,369 A 9/1996 Shen
5,601,047 A 2/1997 Shen
5,653,189 A 8/1997 Payne
6,467,422 B1 10/2002 Elms
6,901,873 B1 6/2005 Lang
10,647,392 B2 * 5/2020 Trewern ..... B63B 32/10
11,453,465 B2 * 9/2022 Trewern ..... B63B 32/10
(Continued)

FOREIGN PATENT DOCUMENTS

CN 109204682 A 1/2019
DE 1781305 A1 12/1970
(Continued)

OTHER PUBLICATIONS

C-8 Polestar Edition, from Candela Technology AB, Available Online via https://candela.com/. Last accessed Jun. 2, 2023.
(Continued)

*Primary Examiner* — Marc Q Jimenez
*Assistant Examiner* — Jovon E Hayes
(74) *Attorney, Agent, or Firm* — Andrus Intellectual Property Law, LLP

(57) ABSTRACT

Hydrofoil apparatuses and associate methods are for lifting a marine vessel relative to water. The hydrofoil apparatus comprising a wing that laterally extends from a port wing side to a starboard wing side relative to the marine vessel, and a propulsor coupled to the wing, the propulsor being configured to induce additional flow of water across the wing, thereby enhancing a lift force on the hydrofoil apparatus for lifting the marine vessel relative to the water.

26 Claims, 11 Drawing Sheets

(56) References Cited

U.S. PATENT DOCUMENTS

| | | | | |
|---|---|---|---|---|
| 11,479,326 | B2 * | 10/2022 | Trewern | B63B 32/64 |
| 2005/0109257 | A1 * | 5/2005 | Lang | B63B 1/288 114/274 |
| 2015/0000584 | A1 * | 1/2015 | Sancoff | B63B 1/14 114/312 |
| 2016/0194054 | A1 * | 7/2016 | Pivec | B63B 1/283 114/145 R |
| 2017/0110157 | A1 | 4/2017 | Sorenson, III | |
| 2018/0072383 | A1 * | 3/2018 | Montague | B63B 1/246 |
| 2023/0234691 | A1 * | 7/2023 | Julliand | B63B 17/0018 |
| 2023/0294796 | A1 * | 9/2023 | Hasselskog | B63B 1/26 114/274 |

FOREIGN PATENT DOCUMENTS

| | | | | |
|---|---|---|---|---|
| EP | 0935553 | B1 * | 9/2001 | B63H 5/08 |
| EP | 3064427 | A1 * | 9/2016 | B63H 25/38 |
| WO | WO-2004074089 | A1 * | 9/2004 | B63H 5/10 |
| WO | WO-2018229353 | A1 * | 12/2018 | B63B 1/26 |
| WO | 2022174295 | A1 | 8/2022 | |
| WO | 2022174296 | A1 | 8/2022 | |

OTHER PUBLICATIONS

Flexofold Folding Propeller, from Flexofold Sailboat Propellers, Available Online via https://www.flexofold.com/. Last accessed Jun. 2, 2023.

Rozhdestvensky, K.; "A Simplified Mathematical Model of Pumped Hydrofoils," J. Mar. Sci. Eng. 2023, 11, 913. https://doi.org/10.3390/jmse11050913.

* cited by examiner

HYDROFOIL APPARATUSES, SYSTEMS, AND METHODS FOR MARINE VESSELS

FIELD

The present disclosure generally relates to hydrofoil apparatuses and related systems and methods for lifting a marine vessel relative to water.

It is known to utilize one or more hydrofoil apparatus(es) to provide lift to a marine vessel in water. As the marine vessel gains speed, the hydrofoil apparatus(es) lift the boat's hull upwardly relative to the water, decreasing drag.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure provides hydrofoil apparatuses for lifting a marine vessel relative to water. The hydrofoil apparatuses comprise a wing that laterally relative to the marine vessel, and a propulsor coupled to the wing, the propulsor being configured to induce additional flow of water across the wing, thereby enhancing a lift force on the hydrofoil apparatus for lifting the marine vessel relative to the water.

In some embodiments, the propulsor comprises a propeller, for example but not limited to dual counter-rotating propellers. In non-limiting embodiments, the wing longitudinally extends from a leading end to a trailing end, and the propulsor is located along the trailing end. In non-limiting embodiments, the propulsor comprises a leading propeller located along the leading end and a trailing propeller located along the trailing end. In non-limiting embodiments the propulsor is coupled to the wing in a cavity located between the leading end and the trailing end. The hydrofoil apparatus may have a single motor configured to rotate both the leading propeller and the trailing propeller, or first motor configured to rotate the leading propeller and a second motor configured to rotate the trailing propeller.

A strut may be configured to support the wing relative to a hull of the marine vessel. In non-limiting embodiments, the propulsor is laterally spaced apart from the strut so that the flow of water flows across the wing and through the propulsor without or with minimal impedance from the strut. In non-limiting embodiments, the propulsor is one of a plurality of propulsors coupled to the wing and configured to induce additional flow of water across the wing, thereby enhancing a lift force on the hydrofoil apparatus for lifting the marine vessel relative to the water. The plurality of propulsors may include outboard propulsors and an inboard propulsor located laterally between the outboard propulsors, wherein the inboard propulsor is larger than the outboard propulsors. In non-limiting embodiments, the wing has a chord length which gradually decreases from a center portion of the wing to a port wing side and to a starboard wing side, respectively. The plurality of propulsors may include outboard propulsors and an inboard propulsor located laterally between the outboard propulsors, wherein the inboard propulsor is capable of generating a larger propulsive force in the water than the outboard propulsors.

The present disclosure also provides hydrofoil systems for lifting a marine vessel relative to water, the hydrofoil system comprising a hydrofoil apparatus comprising a wing that laterally extends from a port wing side to a starboard wing side relative to the marine vessel, a plurality of propulsors coupled to the wing and configured to induce additional flow of water across the wing, thereby enhancing a lift force on the hydrofoil apparatus for lifting the marine vessel relative to the water, and a control module configured to control the plurality of propulsors based upon at least one of a user input, a stored program, and/or an operational characteristic of the marine vessel or the hydrofoil apparatus.

In non-limiting embodiments, the control module is configured to control a speed of operation of the plurality of propulsors based upon an operational characteristic of the marine vessel or the hydrofoil apparatus. In embodiments wherein the plurality of propulsors comprises outboard propulsors and an inboard propulsor located laterally between the outboard propulsors, and the control module may be configured to slow down or turn off the outboard propulsors while continuing an operation of the inboard propulsor once a stored speed of the marine vessel or a propulsion device for the marine vessel is reached. After the stored speed of the marine vessel or the propulsion device for the marine vessel is reached, the control module optionally can be configured to control the outboard propulsors individually apart from each other to facilitate a rolling motion including but not limited to during a turning motion of the marine vessel. In non-limiting embodiments, the control module may be configured to speed up or turn on one of the outboard propulsors, individually and apart from another one of the outboard propulsors, to increase the lift force on one side of the wing and thereby cause the rolling motion for example to facilitate stability of the marine vessel and/or to assist a turning motion of the marine vessel.

In non-limiting embodiments, once a stored speed of the marine vessel or a propulsion device for the marine vessel is reached, the control module may be further configured to cease operation of and then retract the propulsor to thereby reduce flow restriction generated by the propulsor. In these embodiments, the propulsor may comprise a hub and a plurality of propeller blades, wherein the control module is configured to retract propulsor by moving the plurality of propeller blades closer to the hub. In non-limiting embodiments, the propulsor may comprise a hub and first and second diametrically opposed propeller blades and may be configured to retract the propulsor by rotating the first and second diametrically opposed propeller blades into a plane defined through the wing.

The present disclosure also provides embodiments of methods of controlling a hydrofoil apparatus for lifting a marine vessel relative to water. The methods may comprise (1) providing the hydrofoil apparatus with a wing that laterally extends from a port wing side to a starboard wing side relative to the marine vessel, and a propulsor coupled to the wing, the propulsor being configured to induce additional flow of water across the wing, thereby enhancing a lift force on the hydrofoil apparatus for lifting the marine vessel relative to the water, and (2) controlling the propulsor based upon at least one of a user input, a stored program, and/or an operational characteristic of the hydrofoil apparatus or marine vessel.

In non-limiting embodiments, the propulsor is one of a plurality of propulsors coupled to the wing and configured to induce additional flow of water across the wing, thereby enhancing a lift force on the hydrofoil apparatus for lifting the marine vessel relative to the water. The method optionally may further comprise controlling a speed of operation of the plurality of propulsors based upon an operational characteristic of the marine vessel or the hydrofoil apparatus.

Optionally the plurality of propulsors comprises outboard propulsors and an inboard propulsor located laterally between the outboard propulsors, and the method may further comprise slowing down or turning off the outboard propulsors while continuing operation of the inboard propulsor once a stored speed of the marine vessel or a propulsion device for the marine vessel is reached. After the stored speed of the marine vessel or the propulsion device for the marine vessel is reached, the method optionally may further comprise controlling the outboard propulsors individually apart from each other to cause a rolling motion of the marine vessel, thereby facilitating stability of the marine vessel and/or assisting a turning motion of the marine vessel. The method may further comprise speeding up or turning on one of the outboard propulsors, individually and apart from another one of the outboard propulsors, to increase the lift force on one side of the wing and thereby facilitate stability and/or turning. When facilitating a turning motion, once a stored speed of the marine vessel or a propulsion device for the marine vessel is reached, the method may further comprise ceasing operation of and then retracting the propulsor to thereby reduce flow restriction generated by the propulsor.

Various other features, objects, and advantages will be made apparent from the following description taken together with the drawings.

BRIEF DESCRIPTION OF THE DRAWINGS

The present disclosure includes the following drawing figures.

DETAILED DISCLOSURE

During research and development, the present inventors determined that marine vessels, and particularly marine vessels having electric propulsion with limited battery capacity, require low drag hull forms to increase range. The inventors understand that hydrofoils are known to lift marine vessels out of the water to decrease overall drag and thereby increase speed/range. Lift force provided by a hydrofoil is linearly proportional to its overall area and quadratically proportional to the forward flow velocity. For this reason, the present inventors determined that known hydrofoils do not provide enough lift force to move the marine vessel out of the water until a higher speed is reached (usually around 10-15 mph in recreational hydrofoil vessels). The present inventors thus have realized a need in the art to provide improved hydrofoil apparatuses, systems, and methods, wherein the benefits of hydrofoils are extended to lower speed ranges. The present disclosure is a result of these efforts.

Figure 1:
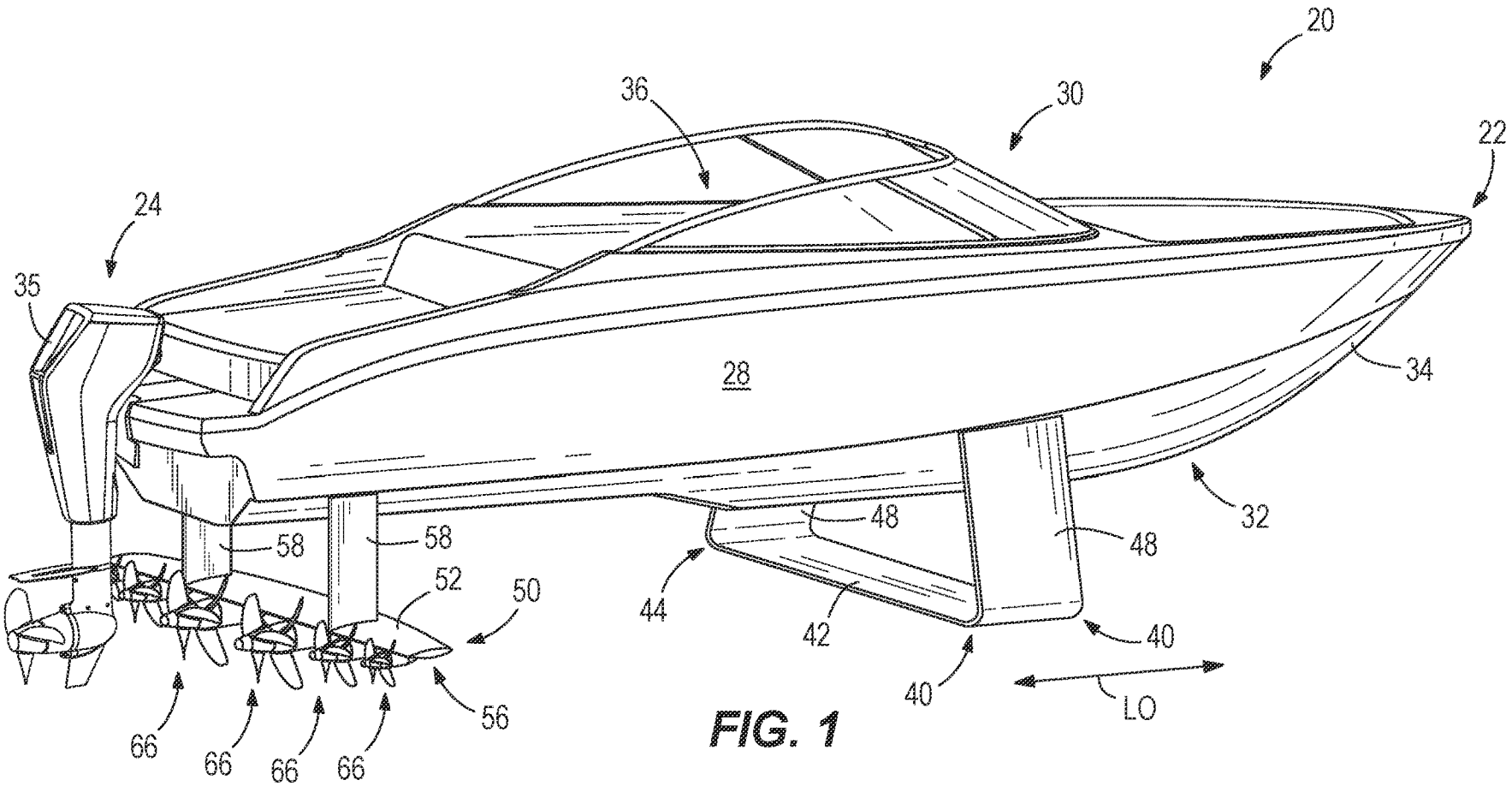
FIG. 1 is a perspective view of a marine vessel having a first embodiment of a hydrofoil apparatus for lifting the marine vessel relative to water.

FIG. 1 depicts an exemplary marine vessel 20. The marine vessel 20 extends from a bow 22 to a stern 24 in a longitudinal direction LO, from a port side 26 to a starboard side 28 in a lateral direction LA which is perpendicular to the longitudinal direction LO, and from a top 30 to a bottom 32 in an axial direction AX which is perpendicular to the longitudinal direction LO and perpendicular to the lateral direction LA. The type and configuration of the marine vessel 20 can widely vary and what is shown in FIG. 1 is merely exemplary. The marine vessel 20 has a hull 34 and a helm 36 defined within the hull 34. Although not shown, the marine vessel 20 also has a propulsion device 35 for propelling the marine vessel 20 in water, which for example can include one or more outboard motors, one or more inboard motors, one or more stern drives, and/or the like. In a non-limiting example, the propulsion device 35 is the electric outboard motor manufactured and sold by Mercury Marine under its trademark Avator®. However, the type and configuration of the propulsion device 35 for propelling the marine vessel 20 can widely vary and can include propulsion devices having an internal combustion engine or a hybrid engine/motor arrangement, and/or any other type of powerhead. As conventional, the apparatus for propelling the marine vessel 20 is controllable by an operator situated on the marine vessel 20, for example at the helm 36 via one more conventional input devices, including but not limited to a steering wheel, joystick, throttle/shift lever, a touch screen, and/or the like.

The marine vessel 20 has a front hydrofoil 40 located forwardly of a midpoint of the marine vessel 20 and extending downwardly from the hull 34. In the depicted embodiment, the front hydrofoil 40 is an elongated wing 42 extending laterally beneath the hull 34 from a port wing side 44 to a starboard wing side 46. Port and starboard struts 48 extend generally axially upwardly from the port wing side 44 and starboard wing side 46 and couple the wing 42 to the hull 34. The front hydrofoil 40 is conventionally configured to provide a lifting force on the hull 34 which tends to lift the marine vessel 20 out of the water as the marine vessel 20 travels through the water. As the marine vessel 20 is propelled by the propulsion device 35 and gains speed in the water, the front hydrofoil 40 operates to lift the hull 34 upwardly relative to the water, decreasing drag on the marine vessel 20. It is however not essential to the present invention that the marine vessel 20 includes the front hydrofoil 40, and as such the front hydrofoil 40 is shown for exemplary purposes only. Also, if the marine vessel 20 includes the front hydrofoil 40, the type and configuration can widely vary from what is shown. For example, the location of the front hydrofoil 40 can be forwardly or rearwardly of what is shown. The shape and size of the wing 42 and shape, size, number, and location of struts 48 can also vary from what is shown.

With continued reference to FIG. 1, the marine vessel 20 also has a novel hydrofoil apparatus 50 which is a subject of the present disclosure. The hydrofoil apparatus 50 is located rearwardly of a midpoint of the marine vessel 20 and extends downwardly from the hull 34. As further described herein below, the hydrofoil apparatus 50 is configured in a novel manner to provide a lifting force on the hull 34, which tends to lift the marine vessel 20 relative to the water, for example partially and/or completely out of the water as the marine vessel 20 travels through the water. In the depicted embodiment, the hydrofoil apparatus 50 is located proximate to the stern 24, i.e., closer to the stern 24 than the midpoint of the marine vessel 20. However, this is not a limiting example, and the hydrofoil apparatus 50 can be located elsewhere with respect to the hull 34. There can also be more than one hydrofoil apparatus 50 and each respective hydrofoil apparatus 50 can be configured differently, having a different physical configuration and/or different functionalities. The illustrated hydrofoil apparatus 50 has a wing 52 which laterally extends from a port wing side 54 to a starboard wing side 56 relative to the marine vessel 20. Port and starboard struts 58 extend generally axially upwardly from the port wing side 54 and the starboard wing side 46 and couple the port wing side 54 and starboard wing side 56 to the hull 34. In the depicted embodiment, the port and starboard struts 58 are located on an inboard side of the port wing side 54 and starboard wing side 56, however the number, location and configuration of struts can vary from what is shown.

Figure 4:
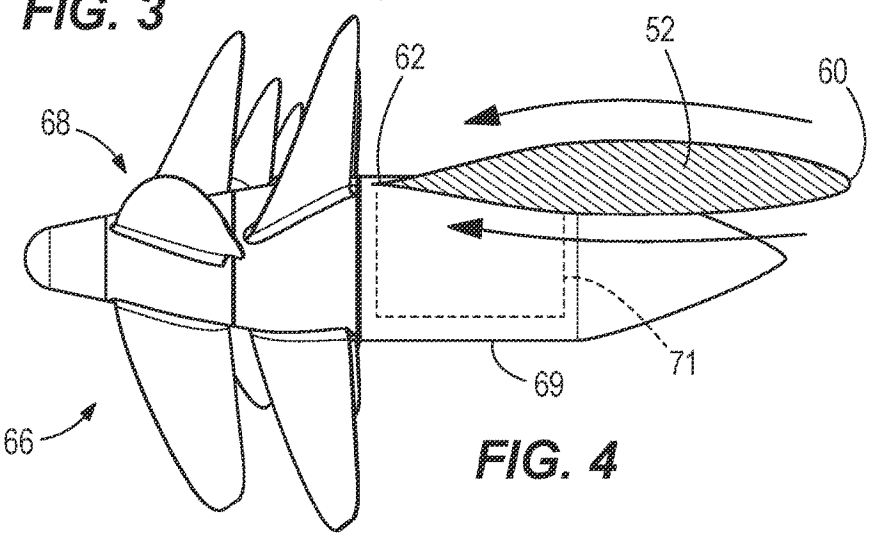
FIG. 4 is a view of section 4-4, taken in FIG. 2.
Figure 5:
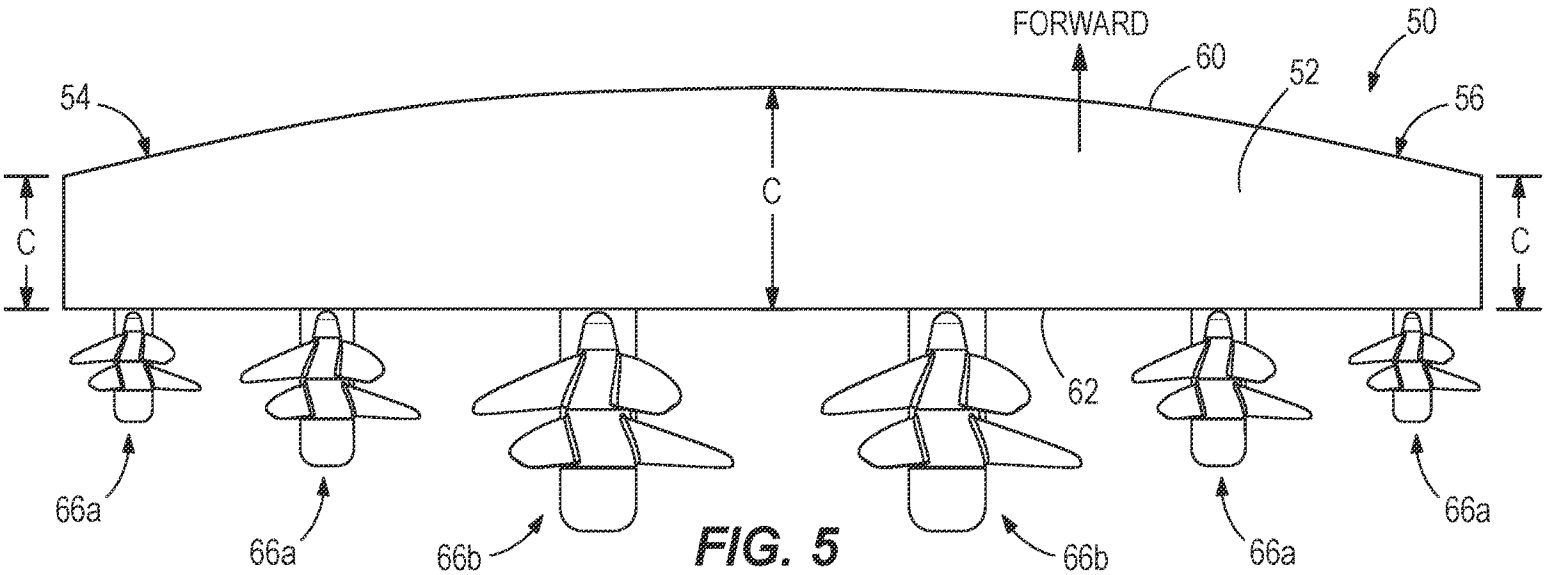
FIG. 5 is a top view of the first embodiment of the hydrofoil apparatus.

Now referring to FIGS. 2-5, the wing 52 laterally extends between the port wing side 54 and starboard wing side 56. The wing 52 longitudinally extends between a leading end 60 and a trailing end 62. The leading end 60 is gradually curved towards the trailing end 62 as the distance away from the center portion increases, whereas the trailing end 62 is generally straight. As such, as shown in FIG. 5, the wing 52 has a chord length C which gradually decreases from a center portion of the wing 52 towards the port wing side 54 and from the center portion of the wing 52 towards the starboard wing side 56. As shown in FIG. 4, the wing 52 has a foil-shaped cross-section with a narrowly tapered shape at the trailing end 62 and a relatively wider, rounded shape at the leading end 62, so that the wing 52 has a tear-drop shape when viewed in the cross-sectional view of FIG. 4. As the marine vessel 20 is propelled and gains speed in the water, the wing 52 is forced through the water in the forward direction, as shown in FIG. 5. This causes water to travel across the wing 52, as shown by arrows in FIG. 4, which generates a lifting force on the wing 52. The lifting force is transferred to the hull 34 via the port and starboard struts 58 and thus lifts the hull 34 upwardly relative to the water, decreasing drag on the marine vessel 20.

The hydrofoil apparatus 50 includes one or more propulsors 66 coupled to the wing 52 and being configured to induce increased flow of water across the wing 52, thereby providing and assisting the noted lift force on the hydrofoil apparatus 50 for lifting the marine vessel 20 relative to the water. The type and configuration of the one or more propulsors 66 can vary, as will be evident from the various embodiments described herein below. In the depicted, non-limiting embodiments, the hydrofoil apparatus 50 has a plurality of propulsors 66, each of which including dual counter-rotating propellers, namely (referring to FIG. 4) a leading propeller 68 and a trailing propeller 70 which in use are rotated in opposite direction relative to each other and which together generate a propulsive force on the hydrofoil apparatus 50, which propels the hydrofoil apparatus 50 and associated marine vessel 20 in the water, for example in the reverse direction or the forward direction shown by an arrow in FIG. 5. The present inventors have determined that utilizing dual-counter rotating propellers instead of single propeller arrangements, it is advantageously possible to employ a relatively smaller propeller diameter and laterally locate the propulsors closer together, as compared to single propeller arrangements. In the first embodiment, the propulsor 66 has a motor housing 69 containing an electric motor 71 which is operably coupled to the leading propeller 68 and trailing propeller 70 in a conventional way so that operation of the electric motor causes counter-rotation of the leading and trailing propellers 70. The motor housing 69 is coupled to the bottom of the wing 52 along the trailing end 62 so that a portion of the propellers 68, 70 extends axially up above the top of the wing 52.

Figure 2:
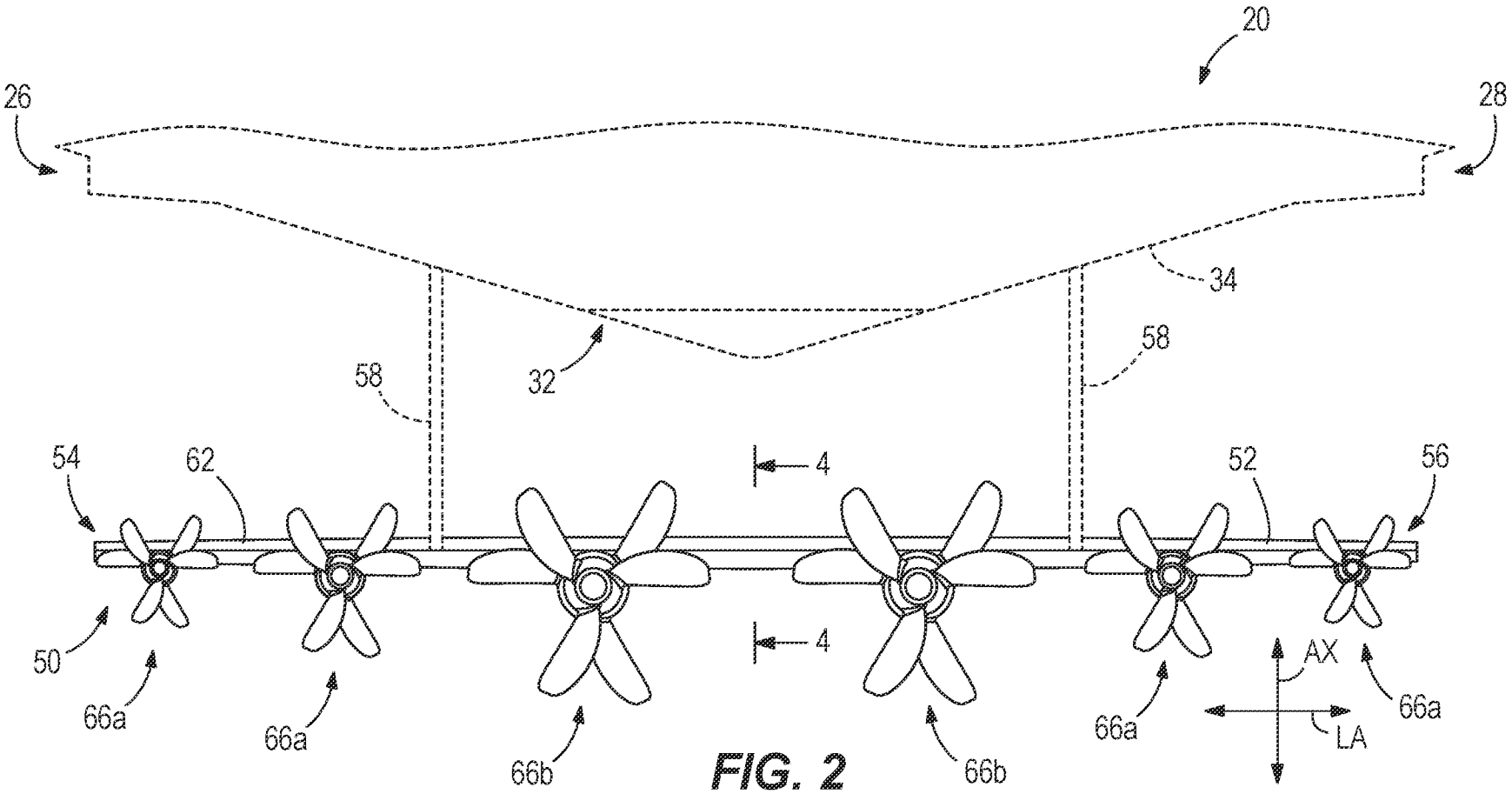
FIG. 2 is a rear view of the first embodiment of the hydrofoil apparatus.
Figure 3:
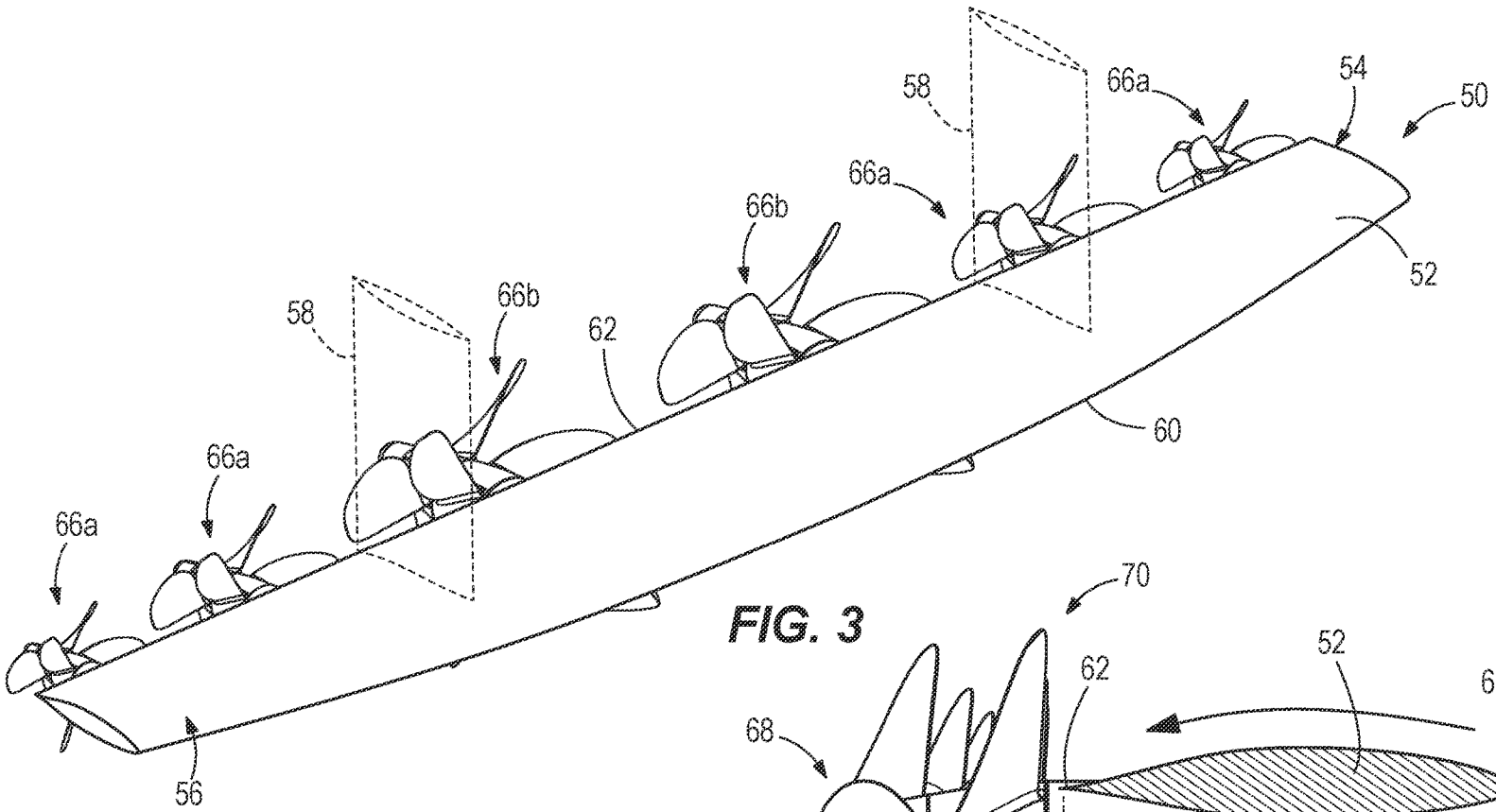
FIG. 3 is a perspective view looking down at the first embodiment of the hydrofoil apparatus.

In the depicted embodiment, the plurality includes six propulsors 66 that are evenly laterally spaced apart along and located along the trailing end 62. In other embodiments, the number of propulsors 66 varies, and the propulsors 66 do not have to be evenly laterally spaced apart. As best seen in FIG. 2, the propulsors 66 in the first embodiment are also laterally spaced apart from the port and starboard struts 58 (i.e., not in line with the struts 58 in the lateral direction LA) so that advantageously the flow of water shown in FIG. 4 freely passes across the top and bottom of the wing 52 and through the propulsors 66 without or with minimal impedance from the port and starboard struts 58. As mentioned above, the number and configuration of propulsors 66 can vary from what is shown. In the first embodiment, the six propulsors 66 include pairs of differently sized outboard propulsors **66*a* located along the port and starboard wing sides 54, 56, respectively. A pair of same sized inboard propulsors 66*b* is located laterally between the respective pairs of outboard propulsors 66*a*, and closer to the center portion of the wing 52 than the outboard propulsors 66*a*. The inboard propulsors 66*b* are sized larger than the outboard propulsors 66*a*, each having a larger hub and larger blades, and thus an overall larger diameter in the axial direction AX than the outboard propulsors 66*a*. Optionally each respective pair of outboard propulsors 66*a* may include a relatively smaller outermost propulsor 66*a* and a relatively larger inboard propulsor 66*b*, so that the plurality of propulsors 66 transition in size from small to large in the lateral direction from outboard to inboard. It will be understood that according to this embodiment, the inboard propulsors 66*b* are relatively more powerful, providing a higher thrust power than the outboard propulsors 66*a*** based at least upon their larger size.

Figure 6:
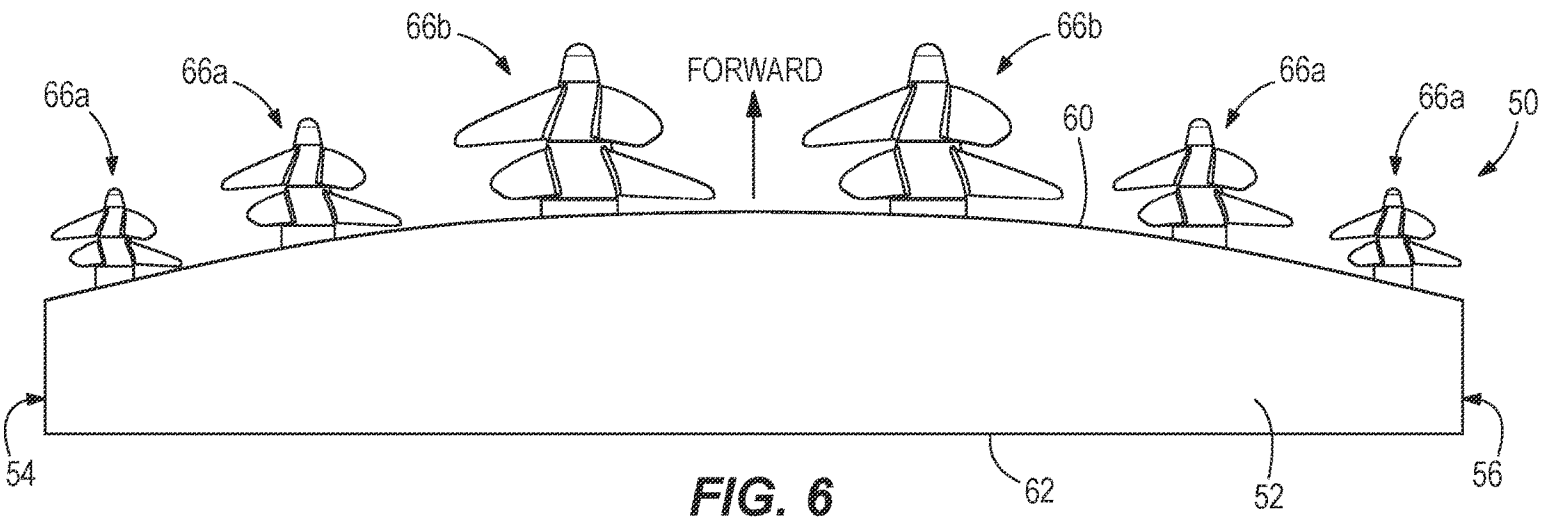
FIG. 6 is a top view of a second embodiment of the hydrofoil apparatus.

FIG. 6 depicts a second embodiment of the hydrofoil apparatus 50, wherein the plurality of propulsors 66 is located along the leading end 60 of the wing 52 rather than the trailing end 62. Lift is proportional to the wing area and velocity squared. The present inventors determined that locating the propulsors 66 in front of the wing 52 may advantageously make it possible to locally increase the flow velocity of the water, compared to the basic flow, thus enabling use of a smaller wing to obtain the same lift performance.

Figure 7:
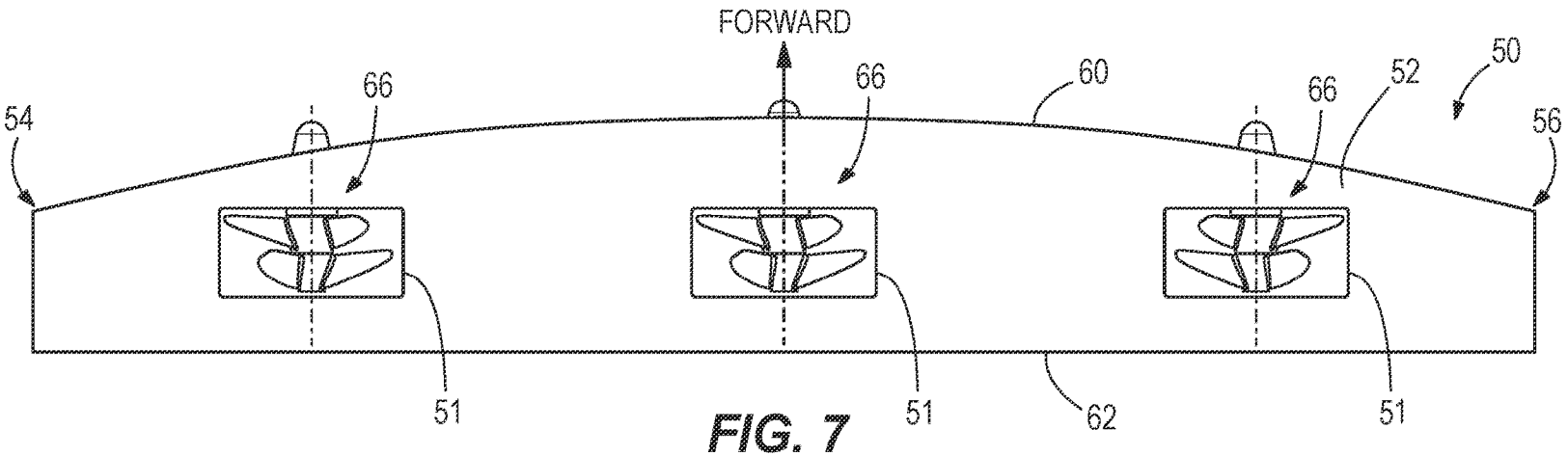
FIG. 7 is a top view of a third embodiment of the hydrofoil apparatus.

FIG. 7 depicts a third embodiment of the hydrofoil apparatus 50 wherein the plurality of propulsors 66 includes three propulsors that are evenly laterally spaced apart and coupled to the wing 52 in a cavity 51 in the wing 52 between the leading end 60 and the trailing end 62.

Figure 8:
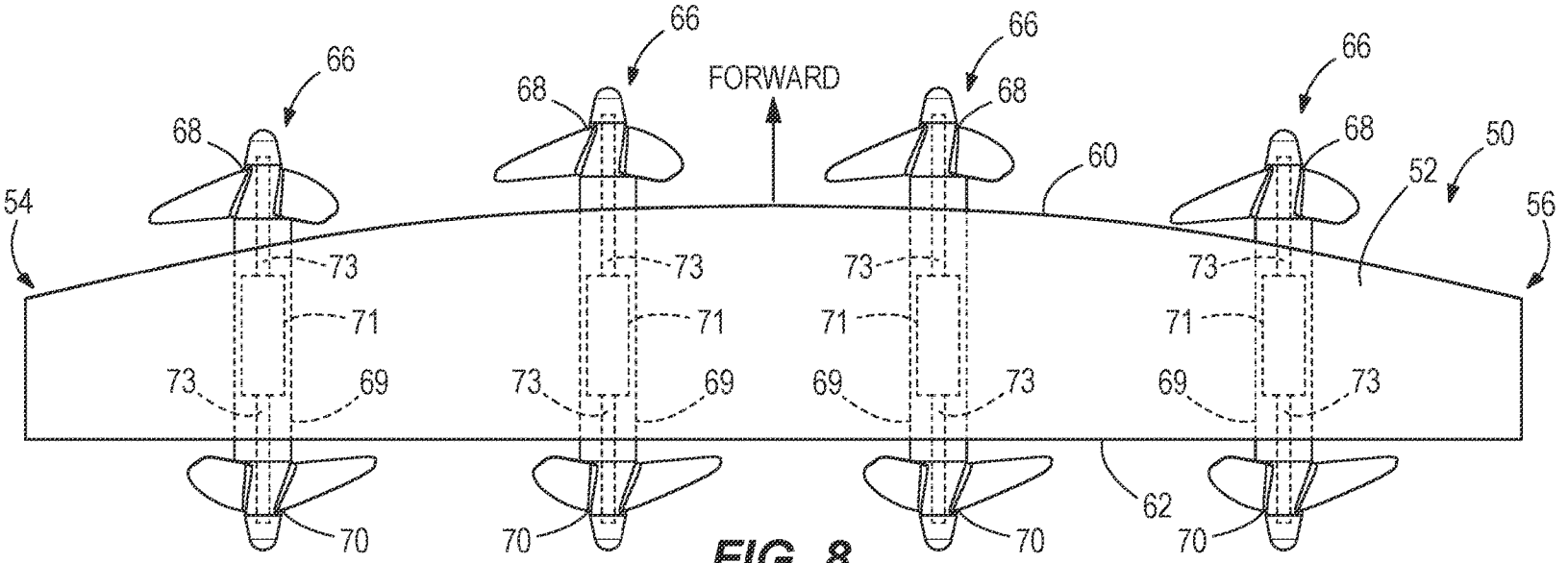
FIG. 8 is a top view of a fourth embodiment of the hydrofoil apparatus.

FIG. 8 depicts a fourth embodiment of the hydrofoil apparatus 50 wherein plurality of propulsors 66 includes four propulsors 66 that are evenly spaced apart and coupled to both sides of the wing 52 in the longitudinal direction LO. The propulsors 66 each include a leading propeller 68 located along the leading end 60 and a trailing propeller 70 located along the trailing end 62. The motor housing 69 is coupled to the bottom of the wing 52 between leading end 60 and the trailing end 62 and has an electric motor 71 with an output shaft assembly 73 that is operably coupled to both the leading propeller 68 and the trailing propeller 70. In some embodiments, operation of the electric motor 71 causes counter-rotation of the leading propeller 68 and trailing propeller 70, as described in the above embodiments. In other embodiments, operation of the electric motor 71 causes commensurate rotation of the leading propeller 68 and trailing propeller 70.

Figure 9:
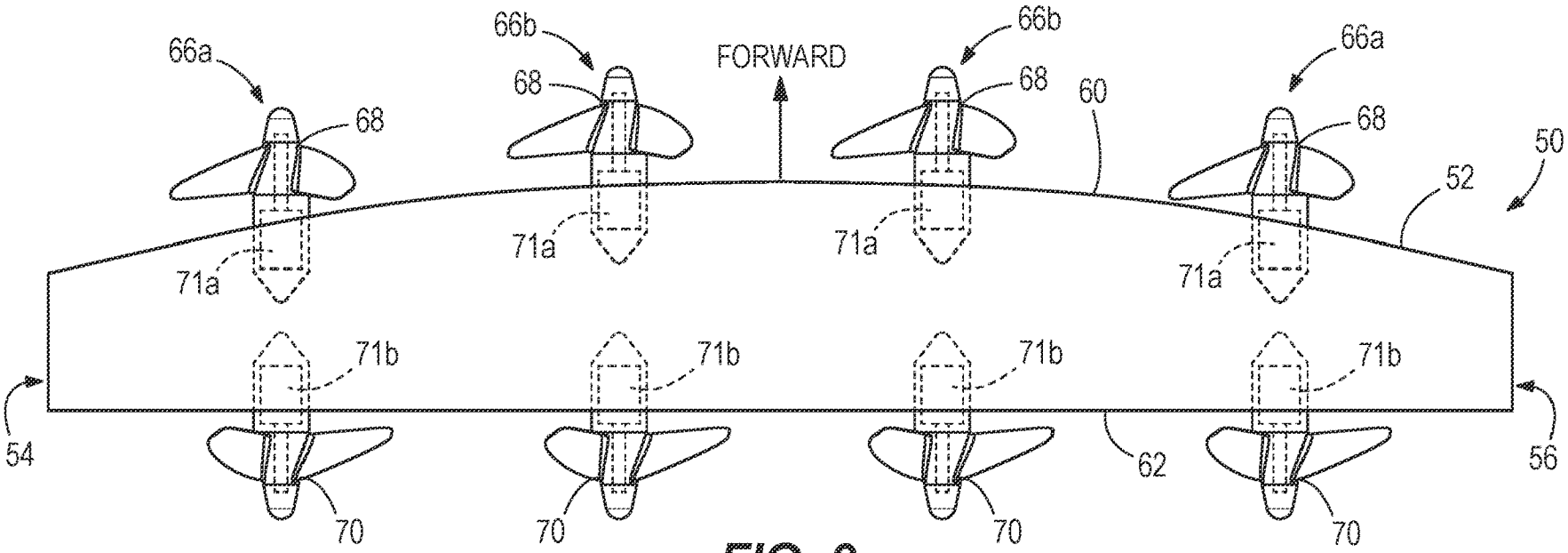
FIG. 9 is a top view of a fifth embodiment of the hydrofoil apparatus.

FIG. 9 depicts a fifth embodiment of the hydrofoil apparatus 50, which is like the above-described fourth embodiment, except having a first motor 71*a* configured to rotate the leading propeller 68 and a second motor 71*b* configured to rotate the trailing propeller 70. The first motor 71*a* is coupled to the bottom of the wing 52 proximate the leading end 60 and the second motor 71*b* is coupled to the bottom of the wing 52 proximate the trailing end 62. As described above regarding the fourth embodiment, operation of the electric motors 71*a*, 71*b* causes counter-rotation of the leading propeller 68 and trailing propeller 70. In other embodiments, operation of the electric motors 71*a*, 71*b* causes commensurate rotation of the leading propeller 68 and trailing propeller 70.

Figure 10:
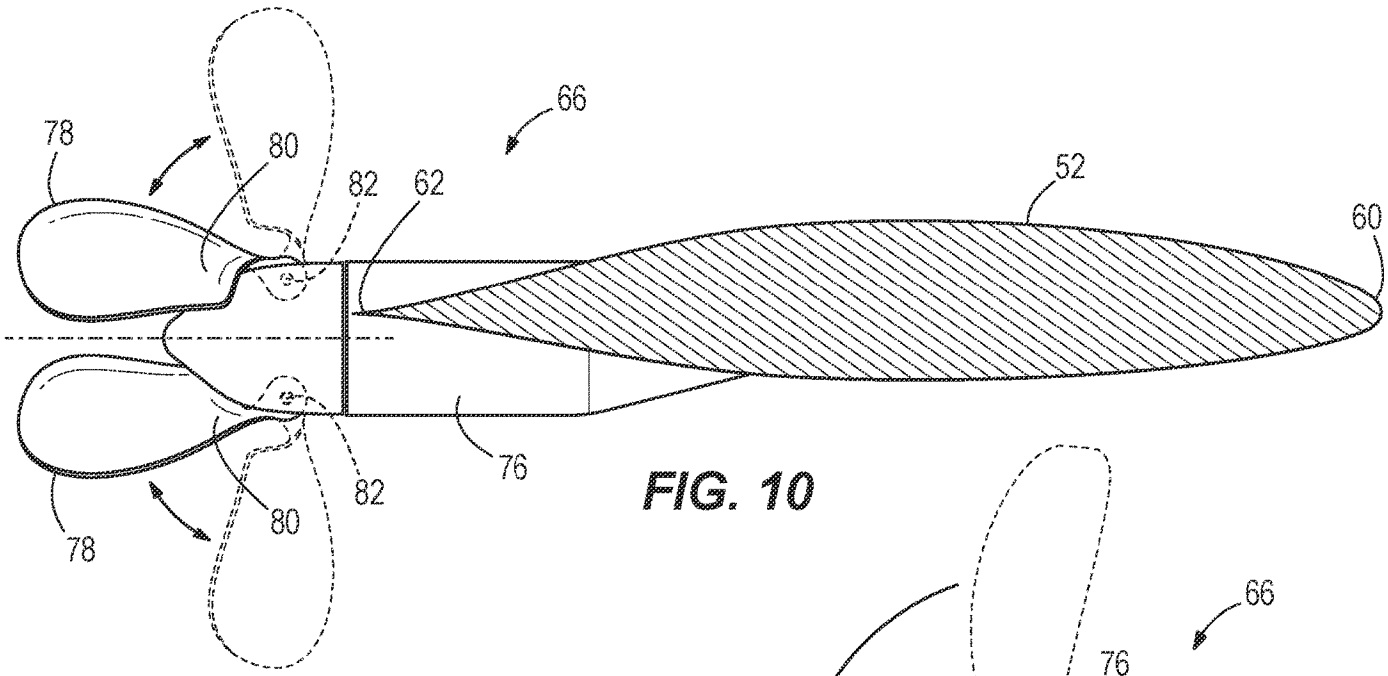
FIG. 10 is a top view of a propulsor having a plurality of propeller blades which are retractable.

FIG. 10 depicts an exemplary propulsor 66 which includes a hub 76 and two diametrically opposed propeller blades 78. The configuration of the hub 76 and the number and configuration of the propeller blades 78 can vary from what is shown. In the depicted embodiment, each of the propeller blades 78 has an inner blade end 80 which is coupled to the hub 76 by a pivot joint such as a pivot pin 82, which permits pivoting of the propeller blade 78 into the retracted position shown in solid lines in FIG. 10, wherein the propeller blades 78 are generally longitudinally aligned with the center axis of the hub 76 so that water more freely passes over the wing 52 with less obstruction from the propeller blades 78. Pivoting of the propeller blade 78 can be enacted by a motor or similar mechanism contained within the hub 76. A suitable example of the illustrated pivoting arrangement for a propeller is known in the art, for example commercially available for purchase from Flexofold Sailboat Propellers.

Figure 11:
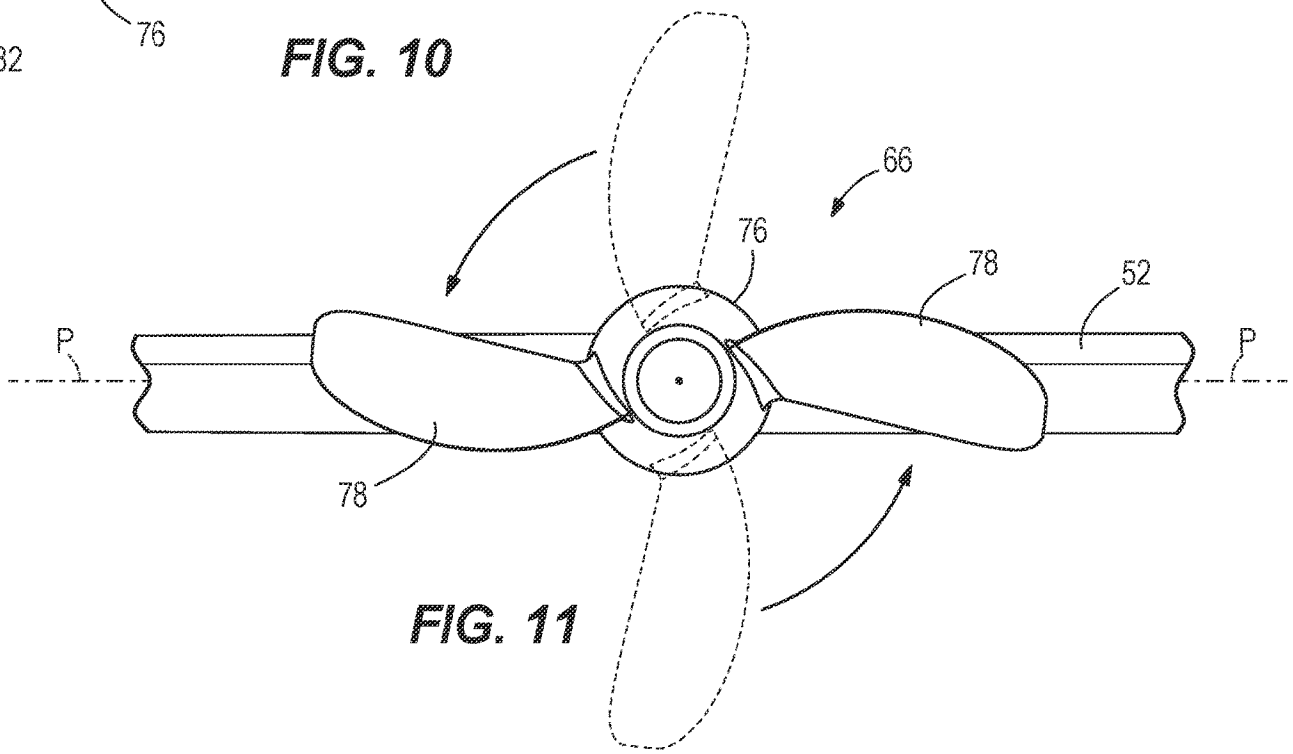
FIG. 11 is a rear view of a propulsor having diametrically opposed propeller blades rotated into a retracted position in which the propeller blades are in alignment with a plane defined by the wing of the hydrofoil apparatus.

FIG. 11 depicts another exemplary propulsor 66 which includes the hub 76 and two diametrically opposed propeller blades 78. The propulsor 66 is rotatable via the electric motor 71 into the retracted position shown in sold lines, wherein the propeller blades 78 are positioned in alignment with a plane longitudinally and laterally defined through the wing 52 so that the water can freely passes over the wing 52 with less or no obstruction from the propeller blades 78. These decreases drag and thus increase speed capability.

FIGS. 12-15 schematically depict a system 100 according to the present disclosure. The system 100 is specially configured for lifting the marine vessel 20 relative to water as the marine vessel 20 is propelled through the water by the propulsion device 35, as will be further described herein below. The system 100 generally includes the hydrofoil apparatus 50 having the wing 52 which laterally extends relative to the marine vessel 20 and the plurality of propulsors 66 coupled to the wing 52 and configured to induce additional flow of water across the wing 52, thereby providing the lift force on the hydrofoil apparatus 50 for lifting the marine vessel 20 relative to the water. The system 100 also includes a control module 102 which is specially configured to control the propulsors 66 together and/or individually, based upon, for example, a user input to the system 100, a program stored in a memory of the system 100, and/or one of a variety of operational characteristics of the marine vessel 20 and/or hydrofoil apparatus 50, as will be further described herein below.

The control module 102 has a processor which is communicatively connected to a storage system comprising a computer readable medium that includes volatile or non-volatile memory upon which computer readable code and data is stored. The processor can access the computer readable code and, upon executing the code, carry out functions, such as the controlling operation of the propulsors 66, as further described below. In alternate embodiments the control module 102 is part of a larger control network such as a controller area network (CAN) or CAN Kingdom network, such as disclosed in U.S. Pat. No. 6,273,771. A person of ordinary skill in the art will understand in view of the present disclosure that various other known and conventional computer control system configurations could be implemented and are within the scope of the present disclosure, and that the control functions described herein may be combined into a different controller or divided into any number of distributed controllers which are communicatively connected.

In the illustrated embodiment, the control module 102 is in electrical communication with the propulsors 66 via one or more wired and/or wireless links, as shown by dashed and solid lines in the figures. In some embodiments, the wired and/or wireless links are part of a network, as described above. The control module 102 is configured to control and controls the propulsors 66, as described herein below, by sending and optionally by receiving electrical signals to the electric motors 71 via the wired and/or wireless links. In non-limiting embodiments, the control module 102 may be configured to send electrical signals to the propulsors 66 that cause the electric motors 71 individually or as a group to turn on and/or turn off. In non-limiting embodiments, the control module 102 may be configured to send electrical signals to the propulsors 66 that cause the electric motors 71 individually or as a group to change speed. In non-limiting embodiments, the control module 102 may also be configured to send electrical signals to the propulsors 66 to move the propulsors 66 into retracted and extended positions, per the above description of the embodiments in FIGS. 10 and/or 11. In non-limiting embodiments, the control module 102 may have control over the direction of rotation of the electric motors 71, thereby controlling a direction of thrust generated by the respective propulsors 66. In non-limiting embodiments, the control module 102 may have independent control over the respective propulsors 66, so that the control module 102 can be configured to independently control and independently control an operational state, including on/off state, speed, and/or retracted/extended position of each of the propulsors 66. Many functional benefits of such control over the propulsors 66 are explained herein below.

In non-limiting embodiments, the control module 102 is also or alternatively configured to control and controls the propulsors 66 based on one or more electric signals received from one or more user input devices located at the helm 36 or remotely from the helm 36. The type of user input device may be conventional and for example, referring to FIGS. 12-15, can include a steering wheel 104 and/or a throttle/shift lever 106. Other suitable input devices include a joystick and/or a touch screen and/or a manually operable switch and/or a personal electronic device such as a mobile phone or tablet and/or the like. As conventional, actuation of the various user input device provides one or more electronic signals to the control module 102, which as further described herein below is programmed to control the propulsors 66 based upon said one or more signals. In non-limiting embodiments, the control module controls the propulsors 66 via one or more of the above-mentioned input devices.

In non-limiting embodiments, the control module 102 is also or alternatively configured to control and controls the propulsors 66 based on programming stored in the memory of the control module 102, alone or in combination with the above-noted one or more inputs from the user input device (s). The processor of the control module 102 is configured to process the program and/or the inputs from the user input device(s) and based upon said processing send electronic signals (control commands) to the propulsors 66, either individually or all together.

In non-limiting embodiments, the control module 102 is also or alternatively configured to control the propulsors 66 based on one or more operational characteristics of the marine vessel 20 or the hydrofoil apparatus 50. The operational characteristic(s) of the marine vessel 20 can be sensed and communicated to the control module 102 via one or more conventional sensors associated with the marine vessel 20 and/or hydrofoil apparatus 50. For example, in some embodiments the system 100 includes a speed sensor 108 which is configured to sense a speed of operation of the marine vessel 20 and/or the propulsion device 35 and communicate the sensed speed to the control module 102. The type and configuration of the speed sensor 108 can vary and can include any conventional such device, including for example a rotary encoder such as the multi-turn "Absolute encoder" available for purchase from Tamagawa Seiki Co., Ltd. Alternatively speed/power can be controlled via sensing electrical current supplied to the electric motor and then controlling the speed of the motor based on the sensed current, in what is commonly referred to as torque control.

Figure 12:
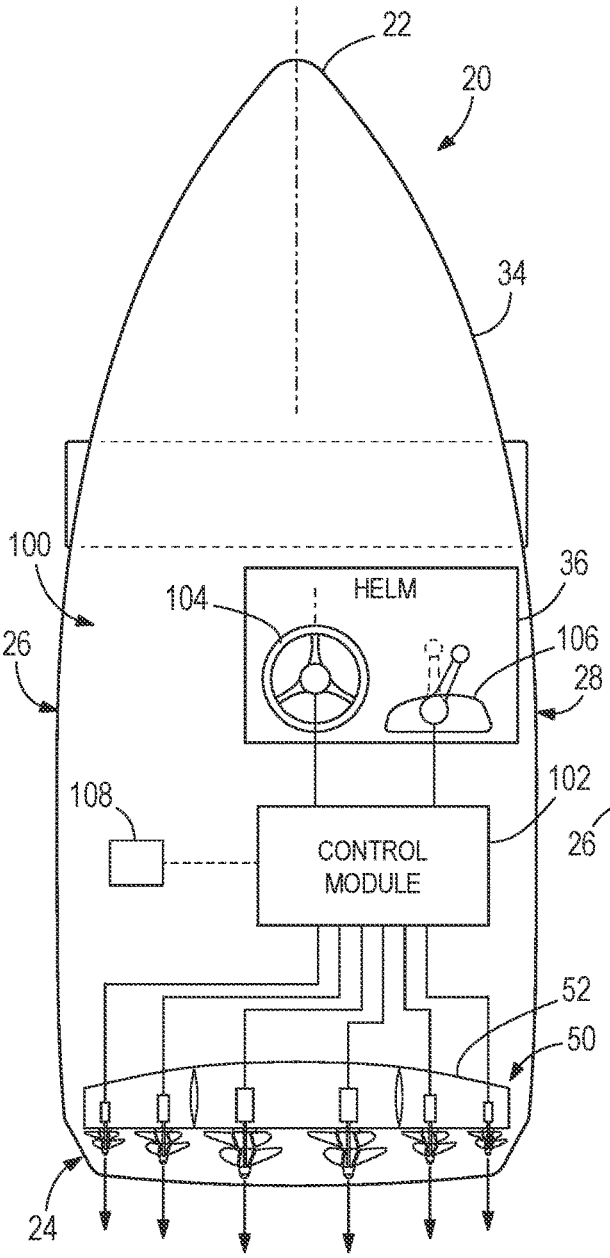
FIG. 12 is a schematic view of a hydrofoil system, showing operation of the hydrofoil apparatus in a first mode.

FIG. 12 depicts the marine vessel 20 and system 100 in a first mode, wherein the user has pivoted the throttle/shift lever 106 forwardly out of neutral position into a first, low speed position, which causes the control module 102 to operate the propulsion device 35 at a first, relatively low speed, in turn causing movement of the marine vessel 20 in the water at a low speed. In this mode, the control module 102 in non-limiting embodiments is programmed to cause the electric motors 71 to operate all the propulsors 66 simultaneously to induce additional flow of water across the wing 52, thereby enhancing a lift force on the hydrofoil apparatus 50 for lifting the marine vessel 20 relative to the water, reducing drag, and facilitating a more efficient performance of the propulsion device 35. The control module 102 can be programmed to cause the electric motors 71 to operate the propulsors 66 based on the position of the throttle/shift lever 106 and/or based upon how the actual speed of the marine vessel 20, as sensed by the speed sensor 108 compares to a speed threshold stored in the memory of the control module 102. The stored speed threshold may be a value selected by the manufacturer of the system 100 and may be calibrated based upon the makeup of the marine vessel 20 and/or configuration of the hydrofoil apparatus 50. For example, if the actual speed of the marine vessel 20 is below the stored speed threshold, the control module 102 may be programmed to operate the entire plurality of propulsors 66. If the stored speed threshold is above the stored speed threshold, the control module may operate according to the second mode, as described herein below with reference to FIG. 13.

Figure 13:
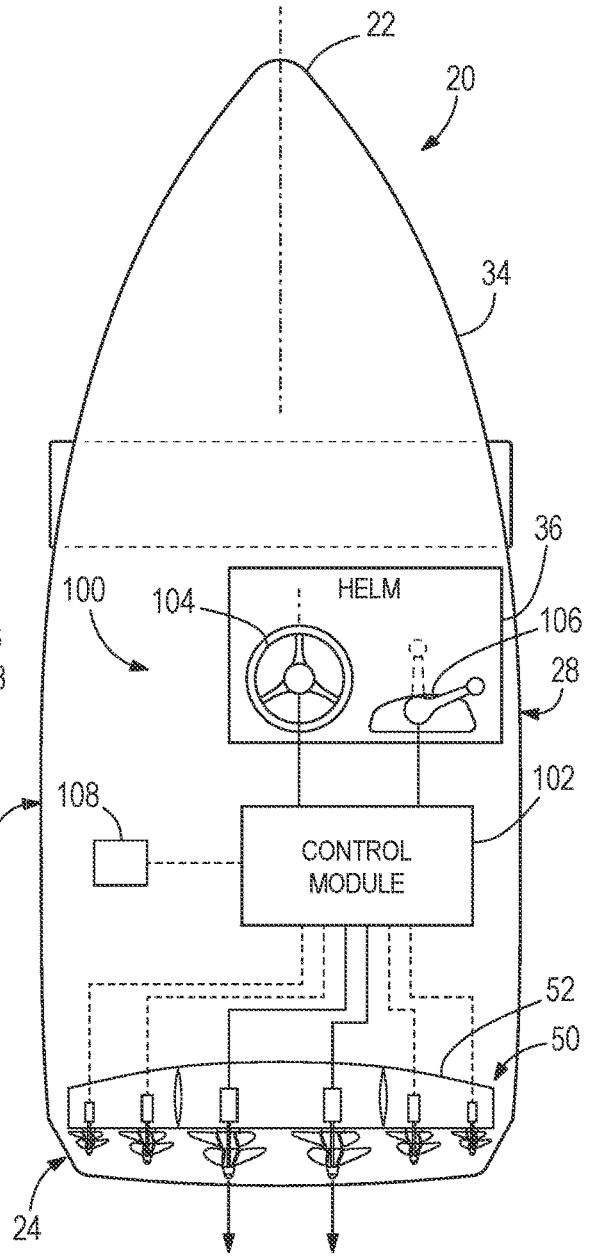
FIG. 13 is a schematic view showing operation of the hydrofoil apparatus in a second mode.

FIG. 13 depicts the marine vessel 20 and system 100 in a second, high speed mode, wherein the user has further pivoted the throttle/shift lever 106 forwardly out of the neutral position into a second position, which causes the control module to operate the propulsion device 35 at a second relatively higher speed, which causes movement of the marine vessel 20 in the water at a relatively higher speed. Once the throttle/shift lever 106 is moved into the second position and that new position is input to the control module 102 and/or once the marine vessel 20 is caused to move at the relatively higher speed and that speed is sensed by the speed sensor 108 and communicated to the control module 102, the control module 102 in non-limiting embodiments is uniquely programmed to cause the electric motors 71 to operate less propulsors 66 than those being operated in the first mode. This is because the present inventors realized that effectively less induced flow velocity is needed to provide the same lifting force as the marine vessel 20 increases speed, because the speed of the marine vessel 20 already increases the flow across the wing 52 thus itself providing more lift. Based on this realization, the inventors configured the control module 102 in some embodiments to selectively slow down or turn off certain propulsors 66 while continuing an operation of other propulsors 66 once a stored speed of the marine vessel 20 is reached, thereby maximizing efficiency of use of the propulsors 66, reducing drag imposed by the propulsors 66 during higher speed translation of the marine vessel, and relying on the above-noted increasing lift force already provided. For example, in some embodiments, in the second mode, the control module 102 is programmed to slow down and/or completely turn off the pairs of outboard propulsors 66*a*, respectively, while continuing operation of the pair of inboard propulsors 66*b*. In other embodiments, in the second mode, the control module 102 is programmed to slow down and/or completely turn off only the outermost outboard propulsors 66*a*, while continuing operation of all the remaining outboard propulsors 66*a* and inboard propulsors 66*b*. Thereafter, in some embodiments, in some embodiments the control module 102 is configured to turn off more or all the remaining outboard propulsors 66*a*, so that as the speed of the marine vessel 20 increases, the number of outboard propulsors 66*a* incrementally decreases. The decreasing operation of the outboard propulsors 66*a* may proceed sequentially from outboard to inboard, which corresponds to changes in the diameter of the propulsors 66 from small to large and chord length C of the wing 52 from small to large.

In some embodiments, in the second mode, the control module 102 may be programmed to cause the inactive propulsors 66 to retract, for example according to the embodiments described herein above regarding FIG. 10 or 11. According to the embodiment of FIG. 10, the control module 102 is configured to control the actuator in the propulsor 66, which as stated above may be a conventional device, such as available from Flexofold, to retract the propeller blades 78 into the position shown in sold lines in FIG. 10, which reduces the drag forces imparted by the propeller blades 78 as the marine vessel 20 travels through the water. According to the embodiment of FIG. 11, the control module 102 is configured to control the motor 71 to rotate the propulsor 66 into the position shown in sold lines in FIG. 11, wherein the propeller blades 78 are aligned with the wing 52 and thus impart less drag compared to any other rotational position of the propeller blades 78, such as the position shown in dashed lines in FIG. 11.

As will be understood by those having ordinary skill in the art, once the actual speed of the marine vessel 20 is reduced to below the stored speed threshold, the control module 102 can be programmed to return to operation under the above-described first mode.

Because in the second mode the outboard propulsors 66*a* are turned off (either all at once, or incrementally from outboard to inboard), the present inventors realized that the area (chord length C) of the wing 52 longitudinally behind the outboard propulsors 66*a* can be designed smaller than the area (chord length C) of the wing 52 behind the inboard propulsors 66*b*. Less area along the outboard portions of the wing 52 is needed as the speed of the marine vessel 20 increases. The inventors found that employing a tapered wing having reduced the chord length C along the lateral length of wing, as shown, advantageously minimizes the plan view at the outer ends of the wings, which minimizes tip vortex losses of the wing.

Figure 14:
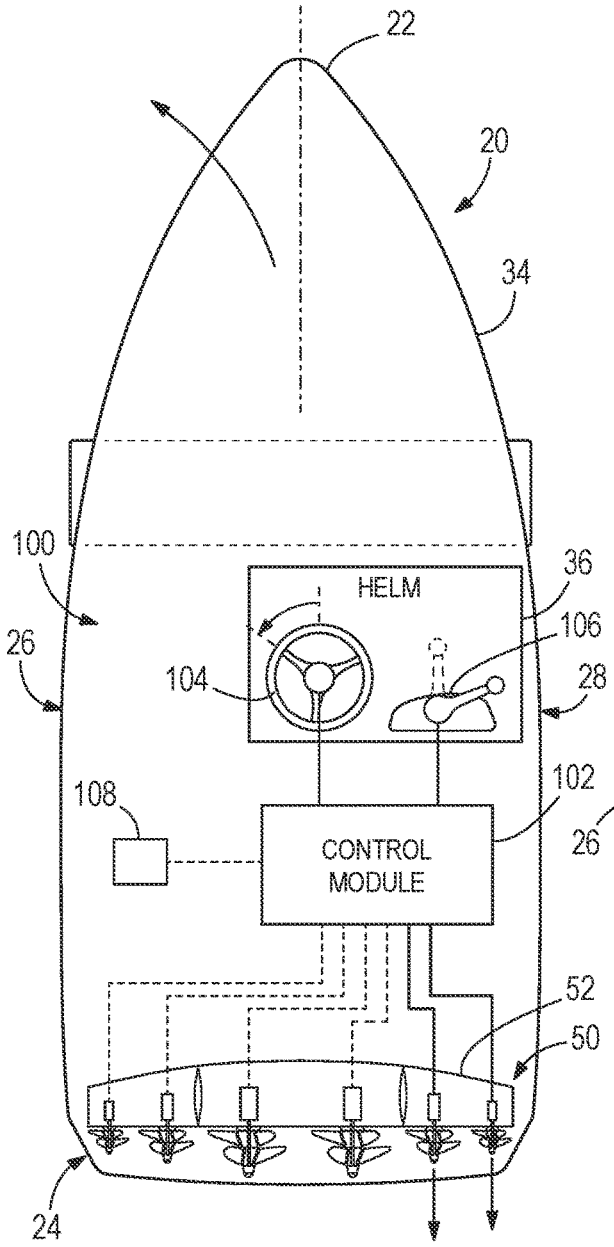
FIG. 14 is a schematic view showing operation of the hydrofoil apparatus in a third mode.

FIG. 14 depicts the marine vessel 20 and system 100 in a third mode, wherein the user has turned the steering wheel 104 towards the port side 26 while the throttle/shift lever 106 is in the second position. As conventional, this causes the control module 102 steer the propulsion device 35 to induce a rolling motion of the marine vessel 20. The rolling motion can be employed to maintain stability of the marine vessel 20, for example in rough waters. In other examples, the rolling motion can be employed to facilitate a turning motion of the marine vessel 20 to the port side 26 by effectively "banking" the marine vessel 20 into the turn. It is known in the art how to configure an input device, control module, and propulsion device to provide such steering control and as such this is not further herein described. In this third mode, the present inventors realized that the outboard propulsors 66*a* are uniquely situated to provide a force which employs a lever arm on the turning vessel 20, based on the lateral distance of the respective outboard propulsor 66*a* from the centerline of the hull 34, which induces roll of the marine vessel 20. In this mode, the control module 102 is uniquely programmed to operate only one or more of the outboard propulsors 66*a* located outwardly along the starboard wing side 56. Doing so advantageously creates a lift force on the starboard side 28 of the marine vessel 20, which as stated above can be utilized to maintain stability of the marine vessel 20 and/or to assist turning of the marine vessel 20 by raising the starboard side 28 relative to the water in a roll motion and thus effectively banking the marine vessel 20 into the turn.

Figure 15:
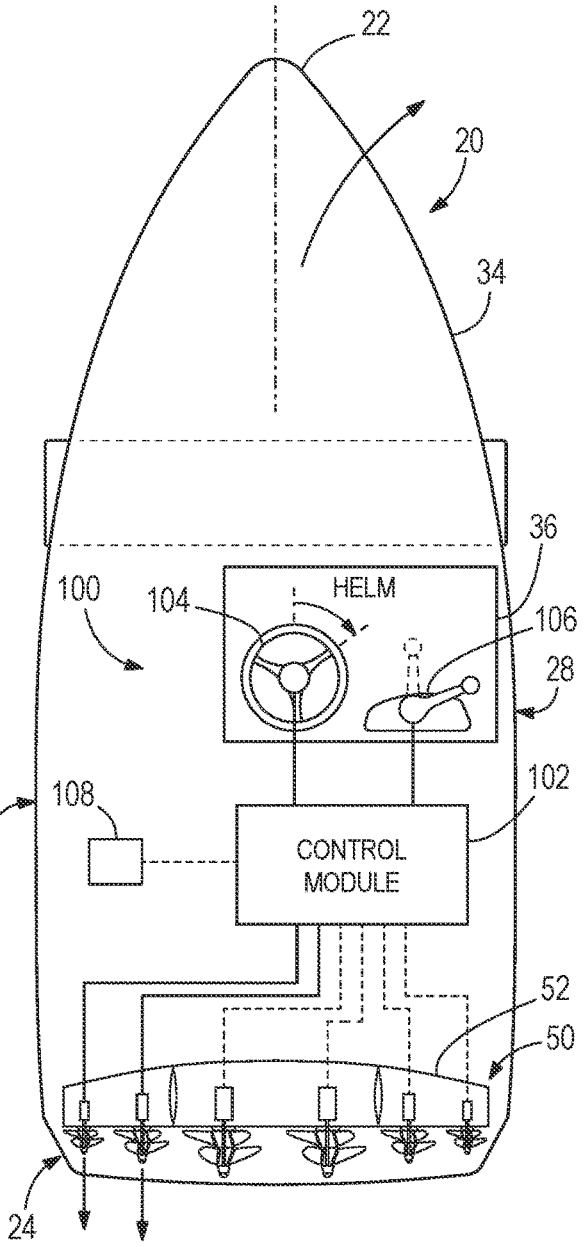
FIG. 15 is a schematic view showing operation of the hydrofoil apparatus in a fourth mode.

FIG. 15 depicts the marine vessel 20 and system 100 in a fourth mode, which is basically the opposite of FIG. 14, wherein the user has turned the steering wheel 104 to the starboard side 28 while the throttle/shift lever 106 is in the second position. The control module 102 is uniquely programmed to operate only one or more of the outboard propulsors 66*a* located along the port wing side 54. The present inventors that doing so advantageously provides a lift force on the port side 26 of the marine vessel 20, which just like the example in FIG. 14, assists with maintaining stability of the marine vessel 20 and/or assists with turning of the marine vessel 20 by raising the port side 18 relative to the water and effectively "banking" the marine vessel 20 into the turn.

It will thus be understood that the control module 102 may be advantageously configured to control the outboard propulsors 66*a* individually apart from each other and apart from the inboard propulsors 66*b* to facilitate stability and/or a turning motion of the marine vessel 20 and then cease this operation once the action is complete.

Figure 16:
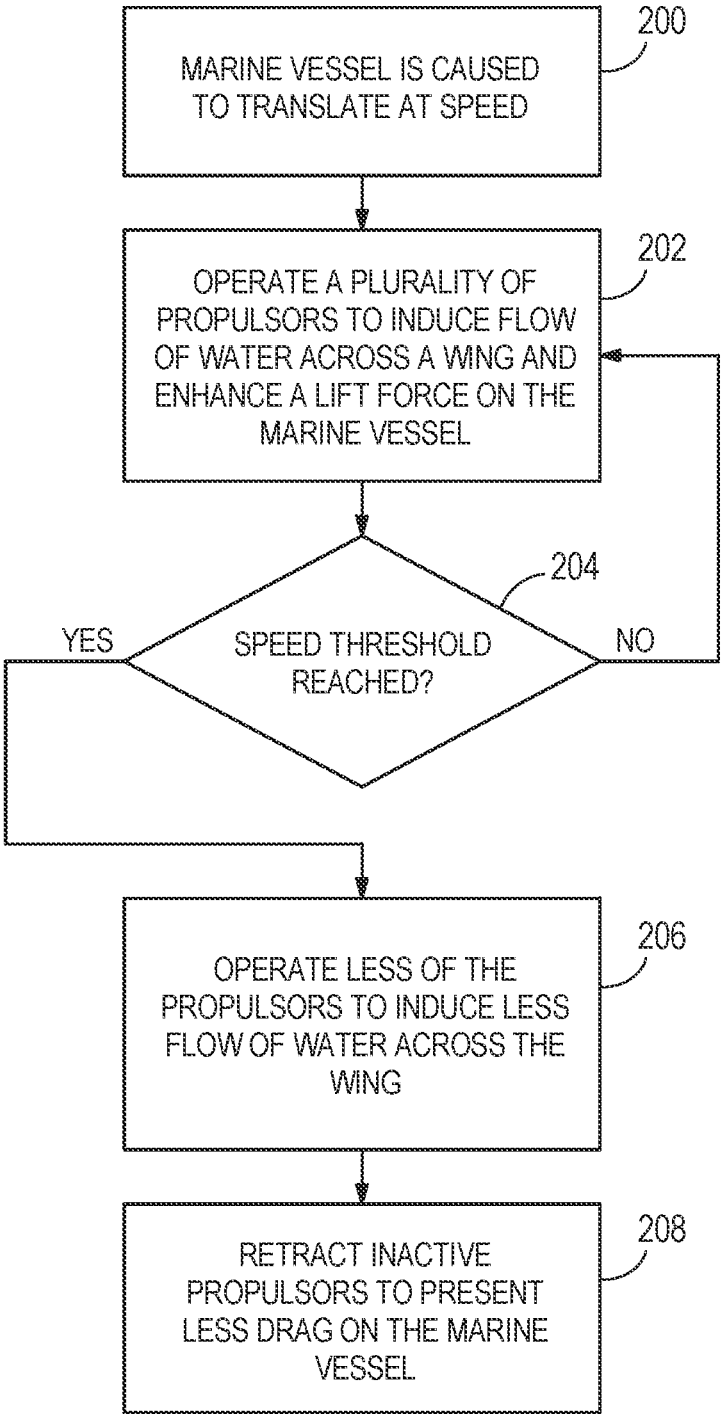
FIG. 16 is one embodiment of steps in a method according to the present disclosure.

FIG. 16 depicts a non-limiting example of the above-described methods under the first and second modes of the control module 102. At step 200, the marine vessel 20 is caused to translate at speed, for example by operation of the propulsion device 35 commanded by operation of the throttle/shift lever 106 and/or any other user input device and/or by operation of the control module 102 according to a stored program. When this occurs, the control module 102 is programmed, at step 202, to operate the plurality of propulsors 66 to induce increased flow of water across the wing 52 (see FIG. 4) to thereby enhance a lift force on the marine vessel 20 via the hydrofoil apparatus 50. At step 204, the control module 102 determines whether the actual speed of the marine vessel 20, as determined for example by the position of the throttle/shift lever 106 and/or other input device, or as determined for example by the speed sensor 108. If not, then the control module 102 continues operation at step 202. If so, then the control module 102 operates less of the propulsors 66 than what was being operated at step 202, to induce less flow of water across the wing 52. For example, as described above, the control module 102 at step 202 ceases operation of one or more outboard propulsors 66*a*, at once, or sequentially. Optionally, at step 208, the control module 102 is configured to thereafter retract the propulsors 66, for example according to the above-described embodiments shown in FIG. 10 or 11. As will be understood, the method may proceed in the opposite manner, as the actual speed of the marine vessel 20 is reduced, such that the propulsors 66 are extended and again operated once the actual speed is reduced to the stored threshold speed, etc.

Figure 17:
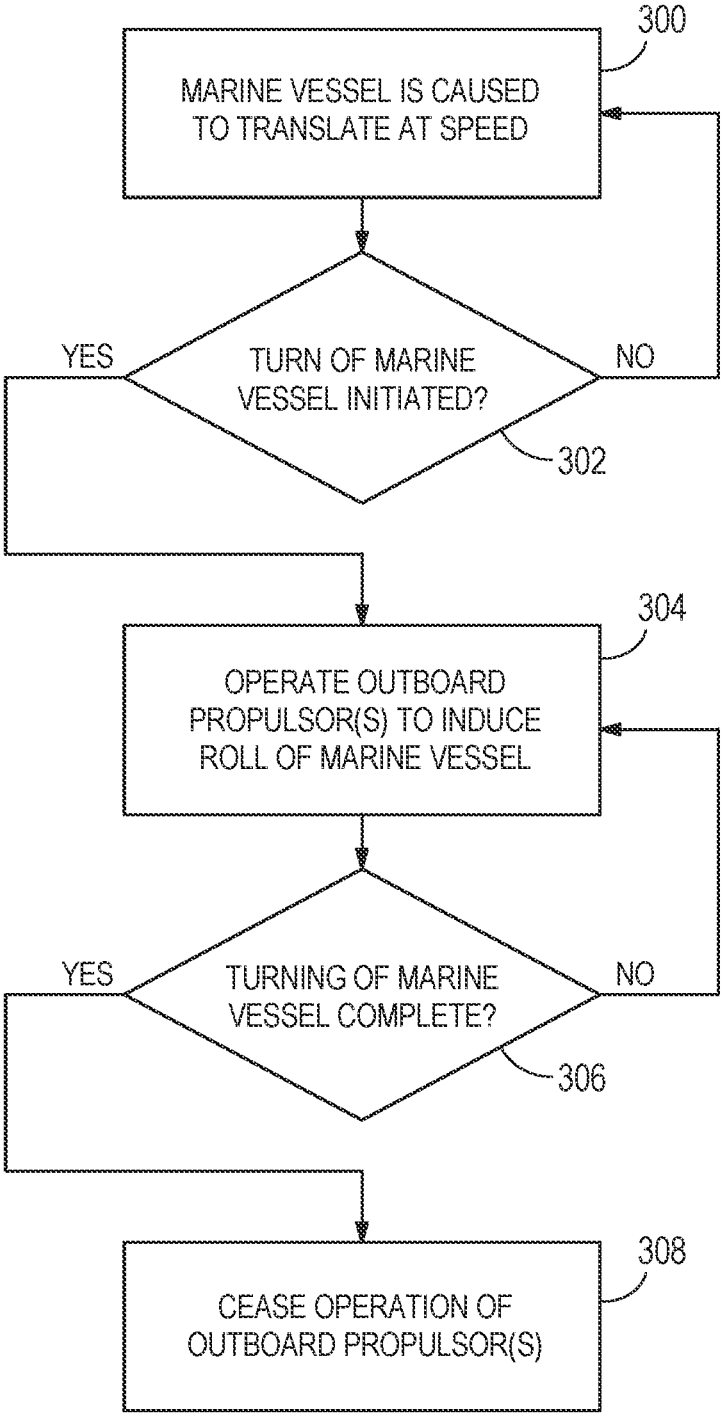
FIG. 17 is another embodiment of steps in a method according to the present disclosure.

FIG. 17 depicts a non-limiting example of the above-described methods under the third or fourth modes of the control module. At step 300, the marine vessel 20 is caused to translate at speed, for example by operation of the propulsion device 35 commanded by operation of the throttle/shift lever 106 and/or any other user input device and/or by operation of the control module 102 according to a stored program. At step 302, the control module 102 determines whether a port or starboard turn of the marine vessel 20 has been initiated, for example by the position of the steering wheel 104 and/or other input device or based upon a program stored in the control module 102. If not, then the control module 102 continues operation at step 300. If so, then the control module 102 operates one or more of the outboard propulsors 66*a* to induce a roll motion of the marine vessel 20, as described herein above according to the third or fourth modes. At step 306, the control module 102 determines whether the turning motion of the marine vessel 20 is complete, for example based on the position of the steering wheel 104 or other input device or based upon a program stored in the control module 102. If not, then the control module 102 continues operation at step 304. If so, then at step 308 the control module at step 308 ceases operation of the outboard propulsors 66*a*. It will thus be understood per FIG. 17 and the above discussion of the third and fourth modes of the control module 102 that the system 100 is specially configured to assist with port and starboard turns by selectively inducing a rolling motion of the marine vessel 20, effectively banking the marine vessel 20 into an efficient turn.

It will also be understood that the above method can be implemented at other times than when a turn is initiated. For example, if the control module 102 determines that the marine vessel 20 is rolling due to wind or waves or other external force such as weight on the deck of the marine vessel 20, which for example can be determined from a conventional gyroscope with input into the control module 102, the control module 102 can be configured to operate one or more of the outboard propulsors 66*a* on the appropriate side of the wing 52 to counteract the external force and thereby level the deck of the marine vessel 20. For example, if the marine vessel 20 encounters a wave on one side which causes the marine vessel 20 to roll, the control module 102, based on an input from the gyroscope sensing the roll, can be configured to operate the outboard propulsors 66*a* on the opposite side, thereby raising the opposite side of the marine vessel 20 and counteracting the roll, i.e., maintaining a generally stable attitude of the deck of the marine vessel 20 in the water.

It will thus be understood from the above figures and description that the present disclosure this provides methods for controlling a hydrofoil apparatus for lifting a marine vessel relative to water, comprising controlling the propulsor based upon at least one of a user input, a stored program, and/or an operational characteristic of the hydrofoil apparatus or marine vessel. The propulsor may be one of a plurality of propulsors coupled to the wing and configured to induce additional flow of water across the wing, thereby enhancing a lift force on the hydrofoil apparatus for lifting the marine vessel relative to the water, and the method may further comprise controlling a speed of operation of the plurality of propulsors based upon the at least one of a user input, the stored program, and/or the operational characteristic of the hydrofoil apparatus or marine vessel. The plurality of propulsors may comprise outboard propulsors and an inboard propulsor located laterally between the outboard propulsors, and the method may further comprise slowing down or turning off the outboard propulsors while continuing operation of the inboard propulsor based upon the at least one of a user input, the stored program, and/or the operational characteristic of the hydrofoil apparatus or marine vessel. The method may comprise speeding up or turning on one of the outboard propulsors, individually and apart from another one of the outboard propulsors, to increase the lift force on one side of the wing and thereby to maintain stability of the marine vessel and/or assist a turning motion of the marine vessel. The method may comprise ceasing operation of and then retracting the propulsor based upon the at least one of a user input, the stored program, and/or the operational characteristic of the hydrofoil apparatus or marine vessel, to thereby reduce flow restriction generated by the propulsor. For example, the method may comprise retracting the propulsor by either moving the plurality of propeller blades closer to the hub or by rotating the plurality of propeller blades into alignment with a plane defined by the wing.

This written description uses embodiments to disclose the invention, and to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other embodiments that occur to those skilled in the art. Such other embodiments are intended to be within the scope of the claims if they have features or structural elements that do not differ from the literal language of the claims, or if they include equivalent features or structural elements with insubstantial differences from the literal language of the claims.

What is claimed is:

1. A hydrofoil apparatus for lifting a marine vessel relative to water, the marine vessel having a main propulsor, the hydrofoil apparatus comprising:

a wing that laterally extends relative to the marine vessel; and an additional propulsor coupled to the wing, the additional propulsor being configured to induce additional flow of water across the wing, thereby enhancing a lift force on the hydrofoil apparatus for lifting the marine vessel relative to the water.

2. The hydrofoil apparatus according to claim 1, wherein the additional propulsor comprises a propeller.

3. The hydrofoil apparatus according to claim 1, wherein the additional propulsor comprises dual counter-rotating propellers.

4. The hydrofoil apparatus according to claim 1, wherein the wing extends longitudinally from a leading end to a trailing end, and wherein the additional propulsor is located along the trailing end.

5. A hydrofoil apparatus for lifting a marine vessel relative to water, the hydrofoil apparatus comprising:

a wing that laterally extends relative to the marine vessel, wherein the wing extends longitudinally from a leading end to a trailing end; and a propulsor coupled to the wing, the propulsor being configured to induce additional flow of water across the wing, thereby enhancing a lift force on the hydrofoil apparatus for lifting the marine vessel relative to the water, wherein the propulsor comprises a leading propeller located along the leading end and a trailing propeller located along the trailing end.

6. The hydrofoil apparatus according to claim 5, further comprising a first motor configured to rotate the leading propeller and a second motor configured to rotate the trailing propeller.

7. The hydrofoil apparatus according to claim 1, wherein the wing comprises a leading end and a trailing end, and wherein the additional propulsor is coupled to the wing in a cavity located between the leading end and the trailing end.

8. The hydrofoil apparatus according to claim 1, further comprising a strut configured to support the wing relative to a hull of the marine vessel, wherein the additional propulsor is laterally spaced apart from the strut so that the flow of water passes across the wing and through the additional propulsor without or with minimal impedance from the strut.

9. The hydrofoil apparatus according to claim 1, wherein the additional propulsor is one of a plurality of additional propulsors coupled to the wing and configured to induce additional flow of water across the wing, thereby enhancing a lift force on the hydrofoil apparatus for lifting the marine vessel relative to the water.

10. A hydrofoil apparatus for lifting a marine vessel relative to water, the hydrofoil apparatus comprising:

a wing that laterally extends relative to the marine vessel; and a plurality of propulsors coupled to the wing, the plurality of propulsors being configured to induce additional flow of water across the wing, thereby enhancing a lift force on the hydrofoil apparatus for lifting the marine vessel relative to the water, wherein the plurality of propulsors comprises outboard propulsors and an inboard propulsor located laterally between the outboard propulsors, and wherein the inboard propulsor is capable of generating a larger propulsive force in the water than the outboard propulsors.

11. The hydrofoil apparatus according to claim 10, wherein the inboard propulsor is sized larger than the outboard propulsors.

12. The hydrofoil apparatus according to claim 11, wherein the wing has a chord length which gradually decreases from a center portion of the wing to a port wing side and to a starboard wing side, respectively.

13. The hydrofoil apparatus according to claim 10, wherein the wing has a chord length which gradually decreases from a center portion of the wing to a port wing side and to a starboard wing side, respectively.

14. A hydrofoil system for lifting a marine vessel relative to water, the marine vessel having a main propulsor, the hydrofoil system comprising:

a hydrofoil apparatus comprising a wing that laterally extends from a port wing side to a starboard wing side relative to the marine vessel, a plurality of additional propulsors coupled to the wing and configured to induce additional flow of water across the wing, thereby enhancing a lift force on the hydrofoil apparatus for lifting the marine vessel relative to the water, and a control module configured to control the plurality of additional propulsors based upon at least one of a user input, a stored program, and/or an operational characteristic of the marine vessel or the hydrofoil apparatus.

15. The hydrofoil system according to claim 14, wherein the control module is configured to control a speed of operation of the plurality of additional propulsors based upon an operational characteristic of the marine vessel or the hydrofoil apparatus.

16. The hydrofoil system according to claim 14, wherein the plurality of propulsors comprises outboard propulsors and an inboard propulsor located laterally between the outboard propulsors, and wherein the control module is configured to slow down or turn off the outboard propulsors while continuing an operation of the inboard propulsor.

17. The hydrofoil system according to claim 16, wherein the control module is configured to speed up or turn on one of the outboard propulsors, individually and apart from another one of the outboard propulsors, to increase a lift force on one side of the wing and thereby to facilitate stability of the marine vessel and/or a turning motion of the marine vessel.

18. The hydrofoil system according to claim 14, the control module is further configured to cease operation of and then retract the plurality of additional propulsors to reduce flow restriction generated by the plurality of additional propulsors.

19. The hydrofoil system according to claim 18, wherein the additional propulsor comprises a hub and a plurality of propeller blades, and wherein the control module is configured to retract the additional propulsor by moving the plurality of propeller blades closer to the hub.

20. The hydrofoil system according to claim 18, wherein the additional propulsor comprises a hub and first and second diametrically opposed propeller blades, and wherein the control module is configured to retract the additional propulsor by rotating the first and second diametrically opposed propeller blades into alignment with a plane defined by the wing.

21. A method of controlling a hydrofoil apparatus for lifting a marine vessel relative to water, the marine vessel having a main propulsor, the method comprising:

providing the hydrofoil apparatus with a wing that laterally extends from a port wing side to a starboard wing side relative to the marine vessel, and an additional propulsor coupled to the wing, the additional propulsor being configured to induce additional flow of water across the wing, thereby enhancing a lift force on the hydrofoil apparatus for lifting the marine vessel relative to the water; and controlling the additional propulsor based upon at least one of a user input, a stored program, and/or an operational characteristic of the hydrofoil apparatus or marine vessel.

22. The method according to claim 21, wherein the additional propulsor is one of a plurality of additional propulsors coupled to the wing and configured to induce additional flow of water across the wing, thereby enhancing a lift force on the hydrofoil apparatus for lifting the marine vessel relative to the water, and further comprising controlling a speed of operation of the plurality of additional propulsors based upon the at least one of a user input, the stored program, and/or the operational characteristic of the hydrofoil apparatus or marine vessel.

23. The method according to claim 22, wherein the plurality of additional propulsors comprises outboard propulsors and an inboard propulsor located laterally between the outboard propulsors, and further comprising slowing down or turning off the outboard propulsors while continuing operation of the inboard propulsor based upon the at least one of a user input, the stored program, and/or the operational characteristic of the hydrofoil apparatus or marine vessel.

24. The method according to claim 23, further comprising speeding up or turning on one of the outboard propulsors, individually and apart from another one of the outboard propulsors, to increase a lift force on one side of the wing and thereby to facilitate a stability of the marine vessel and/or a turning motion of the marine vessel.

25. The method according to claim 21, further comprising ceasing operation of and then retracting the additional propulsor based upon the at least one of a user input, the stored program, and/or the operational characteristic of the hydrofoil apparatus or marine vessel, to thereby reduce flow restriction generated by the additional propulsor.

26. The method according to claim 25, wherein the additional propulsor comprises a hub and a plurality of propeller blades and comprising retracting the additional propulsor by either moving the plurality of propeller blades closer to the hub or by rotating the plurality of propeller blades into alignment with a plane defined by the wing.

* * * * *